United States Patent [19]

Wright

[11] Patent Number: 4,798,198

[45] Date of Patent: Jan. 17, 1989

[54] BODY MASSAGER FOR ALTERNATIVELY APPLYING ROLLING PRESSURE OR DIRECT PRESSURE

[76] Inventor: William T. Wright, 41 Sandy Neck Rd., East Sandwich, Mass. 02537

[21] Appl. No.: 141,634

[22] Filed: Jan. 7, 1988

[51] Int. Cl.[4] ..... A61H 7/00; A61H 15/00

[52] U.S. Cl. ..... 128/57; 128/67

[58] Field of Search ..... 128/57, 60, 61, 59, 128/54, 67

[56] References Cited

U.S. PATENT DOCUMENTS

| | | | |
|---|---|---|---|
| D. 185,246 | 5/1959 | Taran | 128/57 |
| 1,011,498 | 12/1911 | Sphiloff | 128/57 |
| 3,856,002 | 12/1974 | Matsumoto | 128/67 |
| 4,052,982 | 10/1977 | Ozeryonsky | 128/57 |
| 4,266,536 | 5/1981 | Casares | 128/57 |
| 4,648,387 | 3/1987 | Simmons | 128/57 |
| 4,712,539 | 12/1987 | Kim | 128/57 |

*Primary Examiner*—Edgar S. Burr
*Assistant Examiner*—Tonya Lamb

[57] ABSTRACT

A body massage apparatus which comprises a body-encircling element having an one and other end and a rotation wheel at one end and a blunt end at the other end, each end adapted to provide rolling or direct pressure to a portion of the body on use.

3 Claims, 1 Drawing Sheet

BODY MASSAGER FOR ALTERNATIVELY APPLYING ROLLING PRESSURE OR DIRECT PRESSURE

BACKGROUND OF THE INVENTION

It is often desirable to apply various types of pressure to various parts of the body, both for health and for sensual pleasure. Typically, it is quite difficult for the ordinary person to apply pressure to certain back portions of the body trunk, even with the use of various hand-held devices. It is therefore desirable to provide for a body massage apparatus and method which permits the easy application of different types of pressure to the user's body and particularly reach certain back portions of the user's body which would normally be difficult to reach for the application of pressure and to do the same in a simple, low cost, yet effective, body massage apparatus and method.

SUMMARY OF THE INVENTION

The invention relates to a body massage apparatus and method which permits the easy application of various types of pressure to portions of the user's body.

The present invention concerns a body massage apparatus and the application of various types of pressure, such as rolling or rubbing or to include direct pressure, upon various portions of a user's body, particularly the back trunk portions of the user's body which are often difficult to reach in normal usage. The body massage apparatus comprises a body-encircling element, typically semicircular or more in dimensions, for example, about 60% to 70% of a circle, and characterized by an opening therein to permit the placement of the user's body within the body-encircling element, with the body-encircling element having a one and an other end. The body-encircling element may be composed of a variety of materials, but typically is composed of wood or plastic-type material, generally about two-thirds of a circle and about two feet in diameter or sufficient to permit the insertion of the user's body within the body-encircling element for use of the device.

The one end of the body-encircling element includes an acupressure-type device, such as a tapered end or a blunted point, so that the user standing within the body-encircling device may by grasping the body-encircling device direct the blunted end toward a difficult to reach or impossible to reach back portion and apply direct pressure to that portion of the body. The other end of the body-encircling element is characterized by a rotatable wheel blunted at the end thereof and generally extending outwardly from the end of the body-encircling element so as to permit the circumference of the wheel to be used in applying a rolling-type pressure to difficult to reach areas on the body when the user is within the body-encircling element. The rotor or wheel is usually secured to the one end of the body-encircling element and may for example contain a rubber or elastomeric-type tread, either smooth or embossed, which is to be applied to the user's body. In use, the user grasping the body-encircling element moves the element in a circular, often reciprocating, manner about the user's body trunk element so as to permit the rotatable wheel to apply a rolling pressure to the designated part of the user's body. Normally, for example, the rotatable wheel may comprise a metal or plastic wheel having an elastomeric rim and mounted for axial movement about an axis disposed about the other end of the body-encircling element.

In use, the user steps within the opening of the body-encircling element and by grasping the body-encircling element with his hands, raises the body-encircling element to the desired level about the body trunk; thereafter, moves the element about the axis of the body with the desired end, the blunt end or the roller end, disposed and applied to the area where pressure is desired and thereafter moves the body-encircling element with the hands to apply the desired pressure.

The invention will be described for the purposes of illustration only in connection with a particular embodiment. However, it is recognized that various changes, improvements, additions may be made by those persons skilled in the art without departing from the spirit and scope of the invention as described and illustrated.

DESCRIPTION OF THE EMBODIMENTS

Figure 1:
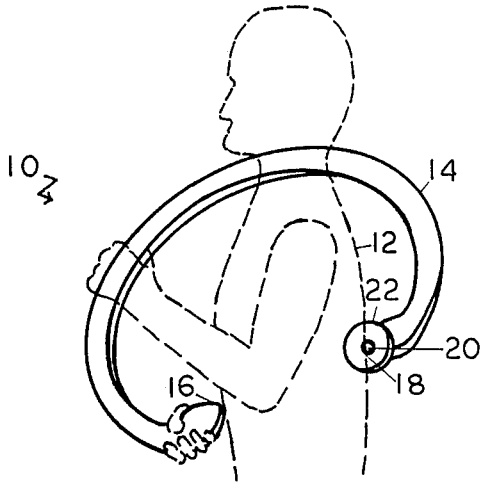
FIG. 1 is a perspective view of the body massage apparatus in use.
Figure 2:
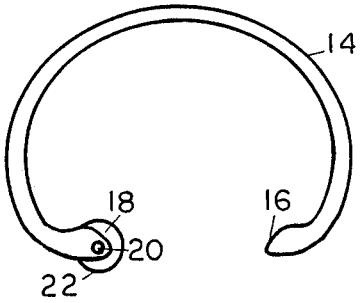
FIG. 2 is a top plan view of the body massage apparatus of FIG. 1.
Figure 3:
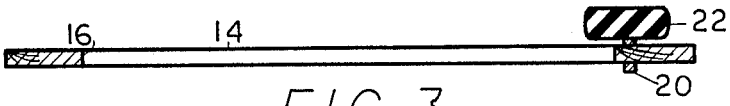
FIG. 3 is an eye plan view of the body massage apparatus of FIG. 1.

FIG. 1 shows a body massage apparatus 10 comprising a body-encircling portion 14 comprising about two-thirds of a circle and comprising a flat, wooden body-encircling element having a blunt, tapered end 16 for the application of acupressure against the portion of the body 12 which the body-encircling portion 14 encircles. The other end of the massage device 10 includes a rotatable wheel 18 having a soft elastomeric, rubber tread 22 and disposed on a bolt axis 20 adapted to be rotated when applied to portions of the body as particularly illustrated in FIG. 1. The body-encircling element 14 has an opening between the blunt end 16 and the wheel 18 at each end which permits the user to place the trunk of his body within the body-encircling element 14.

The body massage device 10 is particularly shown in use in FIG. 1 for the purposes of illustration wherein the user 12 is employing the device by grasping body-encircling element 14 with his hands and applying the rolling pressure toward a portion of the back of body.

The body massage apparatus and method as shown and illustrated provide for a rapid, effective, low cost method of applying pressure to difficult to reach portions of the body.

What is claimed is:

1. A body massage apparatus for the selective application of two different kinds of pressure to portions of a user's body, which apparatus comprises:

(a) a circular, generally flat, body-encircling element having a circumference greater than about sixty percent (60%) of a circle and characterized by an opening therein to permit the placement of the trunk of the user's body within the body-encircling element, the body-encircling element having a one end and an other end;

(b) the said one end having end means tapered toward said opening to provide for the application of direct pressure to selected portions of the body of the user; and (c) the other end having a rotatable wheel means to provide for the alternative application of a rolling-type pressure to selected portions of the body of the user whereby the user places the trunk portion of his body within the body-encircling element, grasps the element with both hands and applies the one or the other end of the element against a selected body portion for the application of pressure thereto.

2. The apparatus of claim 1 wherein the rotatable wheel means comprises a rotable wheel having a rubber tread on the peripheral surface of the wheel means.

3. The apparatus of claim 1 wherein the wheel means comprises an axis positioned toward said other end of the body-encircling element wherein the rotatable wheel means extends outwardly on the said other end of the body-encircling element toward the one end of the said body-encircling element and said wheel rotates in the plane of the said body-encircling element.

* * * * *